US009055662B2

(12) United States Patent
Kleeven

(10) Patent No.: US 9,055,662 B2
(45) Date of Patent: Jun. 9, 2015

(54) CYCLOTRON COMPRISING A MEANS FOR MODIFYING THE MAGNETIC FIELD PROFILE AND ASSOCIATED METHOD

(75) Inventor: Willem Kleeven, Pellenberg (BE)
(73) Assignee: Ion Beam Applications S.A., Louvain-la-Neuve (BE)

( * ) Notice: Subject to any disclaimer, the term of this patent is extended or adjusted under 35 U.S.C. 154(b) by 143 days.
(21) Appl. No.: 13/809,127
(22) PCT Filed: Jul. 4, 2011
(86) PCT No.: PCT/EP2011/061238
§ 371 (c)(1),
(2), (4) Date: Feb. 21, 2013
(87) PCT Pub. No.: WO2012/004225
PCT Pub. Date: Jan. 12, 2012

(65) Prior Publication Data

US 2013/0141019 A1 Jun. 6, 2013

(30) Foreign Application Priority Data

Jul. 9, 2010 (BE) ..... 2010/0415

(51) Int. Cl.
*H05H 7/02* (2006.01)
*H05H 13/00* (2006.01)
*H05H 7/04* (2006.01)

(52) U.S. Cl.
CPC ..... *H05H 13/005* (2013.01); *H05H 7/04* (2013.01); *H05H 13/00* (2013.01)

(58) Field of Classification Search
CPC ..... H05H 13/005
USPC ..... 315/502
See application file for complete search history.

(56) References Cited

U.S. PATENT DOCUMENTS 1,948,384 A * 2/1934 Lawrence ..... 315/500
2,504,585 A * 4/1950 Reid ..... 376/199

(Continued)

FOREIGN PATENT DOCUMENTS

GB 1304630 A 1/1973

OTHER PUBLICATIONS

W. Beeckman et al., "Machining and Assembly of the IBA C70 Cyclotron Magnet." Cyclotrons and Their Applications 2007, Eighteenth International Conference, pp. 81-83.

(Continued)

*Primary Examiner* — Douglas W Owens
*Assistant Examiner* — Srinivas Sathiraju
(74) *Attorney, Agent, or Firm* — Fitch, Even, Tabin & Flannery LLP

(57) ABSTRACT

The present invention relates to a cyclotron capable or producing a first beam of accelerated charged particles defined by a first <<charge-over-mass>> ratio (q/m) or a second beam of accelerated charged particles defined by a second <<charge-over-mass>> ratio (q/m)' less than said first <<charge-over-mass>> ratio (q/m), said cyclotron comprising:

an electromagnet comprising two poles, preferably an upper pole and a lower pole, positioned symmetrically relatively to a middle plane perpendicular to the central axis of the cyclotron and separated by a gap provided for circulation of the charged particles, each of said poles comprising several sectors positioned so as to have an alternation of areas with a narrow gap called <<hills>> and areas with a wide gap called <<valleys>>;

a main induction coil for generating an essentially constant main induction field in the gap between said poles and a means for modifying the magnetic field profile according to the <<charge-over-mass>> ratio of the particles to be accelerated, comprising a ferromagnetic part present in one of said valleys and extending radially from a region close to the center to the periphery of the cyclotron, said ferromagnetic part forming a magnetic circuit with the bottom of said valley, so as to generate a sufficiently large additional magnetic field for accelerating particles of said first beam having said first charge-over-mass ratio (q/m); characterized by:

a secondary induction coil positioned around said ferromagnetic part so as to be able to induce a magnetic field opposing the magnetic field induced in said ferromagnetic part by said main induction coil and reduce the contribution of the additional magnetic field provided by said ferromagnetic part for accelerating the particles of said second beam having said second charge-over-mass ratio (q/m)'.

12 Claims, 3 Drawing Sheets

(56) References Cited

U.S. PATENT DOCUMENTS

| | | | | |
|---|---|---|---|---|
| 2,673,928 | A * | 3/1954 | Gurewitsch | 315/504 |
| 3,789,355 | A * | 1/1974 | Patton | 367/137 |
| 5,052,638 | A * | 10/1991 | Minovitch | 244/53 R |
| 5,521,469 | A * | 5/1996 | Laisne | 315/502 |
| 5,773,919 | A * | 6/1998 | Seward | 313/231.31 |
| 6,057,655 | A * | 5/2000 | Jongen | 315/502 |
| 6,777,699 | B1 * | 8/2004 | Miley et al. | 250/492.3 |
| 7,015,661 | B2 * | 3/2006 | Korenev | 315/500 |
| 7,271,400 | B1 * | 9/2007 | Shaban et al. | 250/492.3 |
| 7,919,765 | B2 * | 4/2011 | Timmer | 250/505.1 |
| 8,106,570 | B2 * | 1/2012 | Norling et al. | 313/62 |
| 8,558,485 | B2 * | 10/2013 | Antaya | 315/502 |
| 8,581,525 | B2 * | 11/2013 | Antaya et al. | 315/502 |
| 8,653,762 | B2 * | 2/2014 | Eriksson et al. | 315/501 |
| 2010/0282979 | A1 * | 11/2010 | Norling et al. | 250/396 ML |
| 2012/0217903 | A1 * | 8/2012 | Tanaka et al. | 315/502 |
| 2013/0303824 | A1 * | 11/2013 | Stephani et al. | 600/1 |
| 2013/0307438 | A1 * | 11/2013 | Morehouse | 315/502 |
| 2014/0001983 | A1 * | 1/2014 | Pacquet et al. | 315/502 |

OTHER PUBLICATIONS

E. Conard et al., "Current Status and Future of Cyclotron Development at IBA." Proceedings of EPAC 1990, Jun. 12, 1990, pp. 419-421.

TH. Vanderlinden et al., "Three Years of Operation of Cyclone 30 in Louvain-La-Neuve." Proceedings of EPAC 1990, Jun. 12, 1990, pp. 437-439.

S. Zaremba et al., "Magnetic Field Design and Calculations for the IBA C70 Cyclotron." Cyclotrons and Their Applications 2007, Eighteenth International Conference, Oct. 1, 2007, pp. 75-77.

International Search Report, International Patent Application No. PCT/EP2011/061238, dated Sep. 23, 2011, 3 pages.

* cited by examiner

CYCLOTRON COMPRISING A MEANS FOR MODIFYING THE MAGNETIC FIELD PROFILE AND ASSOCIATED METHOD

CROSS REFERENCE TO RELATED APPLICATIONS

This application is a national phase application of International Application No. PCT/EP2011/061238, filed Jul. 4, 2011, designating the United States and claiming priority to Belgian Patent Application No. 201000415, filed Jul 9, 2010, which is incorporated by reference herein.

OBJECT OF THE INVENTION

The present invention relates to a cyclotron and to a method for modifying the magnetic field profile in the cyclotron according to the <<charge-over-mass>> ratio of a particle to be accelerated.

TECHNOLOGICAL BACKGROUND AND STATE OF THE ART

Cyclotrons are circular accelerators with which charged particles may be accelerated, such as positive ions (protons, deuterons, helium nuclei, alpha particles, etc.) or negative ions ($H^-$, $D^-$, etc.), which are used i.a. for producing radioactive isotopes, for radiotherapy, or for experimental purposes. A cyclotron of the isochronous type essentially comprises:

- an electromagnet comprising an upper pole and a lower pole, positioned symmetrically relatively to a middle plane, perpendicular to the central axis of the cyclotron, and separated by a gap provided for the circulation of charged particles, each of said poles comprising several sectors positioned so as to have an alternation of areas with a narrow gap commonly called <<hills>> and of areas with a wide gap commonly called <<valleys>>;
- flux returns for closing said magnetic circuit;
- a main induction coil for generating a essentially constant main induction field in the gap between said poles.

An example of a cyclotron of the isochronous type is described in document BE1009669. In an isochronous cyclotron, the profile of the magnetic field should be such that the frequency of rotation of the particles is constant and independent of their energy. In order to compensate the relativistic mass increase of the particles, the average magnetic field should increase with the radius so as to ensure this isochronism condition. In order to describe this relationship, the field index is defined by the following relationship (1):

$$n = \frac{R}{B}\frac{dB}{dR} \tag{1}$$

wherein dB/B and dR/R are respectively relative variations of the magnetic field B and of the radius with respect to the radius R.

The increase in the intensity of the magnetic field is effected according to a law given by equation (2):

$$B(R) = B_0\sqrt{\left[1 - \frac{(qB]_0 R}{m_i c}\right)^2} \tag{2}$$

wherein

B(R) is the average magnetic field around a circle of radius R;

B0 is the magnetic field at the center of the cyclotron;

q, the charge of the particle;

$m_i$, the rest mass;

and c, the velocity of light.

In the following of the text, $m_i$ will be considered in a first approximation as the mass of the particle m given by the product of the mass number A by the nucleon mass $m_N$.

In certain isochronous cyclotrons, the sectors are machined so as to accelerate one type of particle with a well specified <<charge over mass>> q/m. For example a cyclotron for which the sectors are machined for accelerating particles with a <<charge-over-mass>> ratio q/m=½ may accelerate alpha particles, deuterons $D^-$, $HH^+$, $^6Li^{3+}$, $^{10}B^{5+}$ or $^{12}C^{6+}$ or other particles with the same q/m ratio=½. The acceleration of another type of particles with a ratio of q/m=1 requires the use of another cyclotron for which the sectors are machined for acceleration of this type of particles.

It is nevertheless possible in an isochronous cyclotron to pass from a first magnetic field profile allowing acceleration of a first type of particles to a second magnetic field profile for accelerating a second type of particles, wherein by means of concentric annular coils for magnetic field correction, positioned at the surface of the poles according to a well specified distribution, each of said concentric coils being connected to a specific current generator in order to induce the required additional magnetic field. An example of such a device is described in document U.S. Pat. No. 3,789,355. Nevertheless, the number of coils each connected to a specific current generator, the distribution of these coils and the current to be applied in each coil for obtaining the desired magnetic field, complicate the making and the use of this kind of cyclotrons.

Other cyclotrons, such as the Cyclone 18/9 of IBA, have been designed so as to be able to accelerate different types of ions characterized by their different <<charge-over-mass>> ratio q/m. The cyclone 18/9 may accelerate protons (q/m=1) to an energy of 18 MeV, deuterons (q/m=½) to an energy of 9 MeV. The isochronous magnetic field profile has to be adapted depending on the type of particles to be accelerated. FIG. 1 shows the profiles of average magnetic fields <B> versus the average radius <R> of the particle in the cyclotron for accelerating particles with a ratio q/m equal to 1 and particles with a <<charge-over-mass>> ratio q/m equal to a ½. By virtue of equation (2), for a same average radius of the particle in the cyclotron, the average magnetic field should be larger for accelerating protons than for accelerating deuterons. In the case of the Cyclone 18/9 and Cyclone 30/15 of IBA, a mechanical means supports ferromagnetic plates which extend, in two opposite valleys, from an area close to the center of the cyclotron to the periphery of the cyclotron. For accelerating protons, said mechanical means positions said ferromagnetic plates in proximity to the middle plane of the cyclotron in order to provide an additional field giving the possibility of obtaining the required isochronous magnetic field profile. For accelerating deuterons requiring a different average magnetic field profile according to the average radius, said ferromagnetic plates are moved away relatively to the middle plane so as to decrease or suppress the intensity of the additional magnetic field and obtain the required isochronous magnetic field profile for accelerating deuterons.

In the case of low energy cyclotrons, the corrections to be carried out on the magnetic field for passing from one magnetic field profile intended for accelerating particles with a ratio q/m=½ to a magnetic field profile intended for accelerating particles with a ratio q/m=1 do not require the application of an additional magnetic field which is too large. In a first approximation, it is considered that for accelerating protons, the profile of the average magnetic field versus the average radius varies by increasing by about 1% per <<step>> of 10 MeV. The profile of the average magnetic field versus the average radius increases by about 0.5% per step of 10 MeV for the case of deuterons. For example, for a 10/5 cyclotron capable of accelerating protons to an energy of 10 MeV and deuterons to an energy of 5 MeV, the variation of the average magnetic field from the center of the cyclotron to the end of the poles is of 1% for the proton and 0.25% for the deuteron. In this case, said ferromagnetic plates as used in the Cyclone 18/9 and Cyclone 30/15 are sufficient for producing the additional magnetic field required for accelerating protons. If it is desired to design a cyclotron capable of accelerating protons to 70 MeV and deuterons to 35 MeV, the variation of the profile of the average magnetic field from the center of the cyclotron towards the end of the poles would have to be about 7% for accelerating protons and 1.75% for accelerating deuterons. For accelerating deuterons, the variation of the profile of the average magnetic field versus the average radius only requires adequate machining of the sectors, i.e. an azimuthal widening of the hills in proximity to the ends of the poles. If this solution for accelerating deuterons poses very little problems as regards manufacturing, on the other hand for accelerating protons, said ferromagnetic plates should be able to reduce sufficient additional magnetic field for obtaining the desired average magnetic field profile versus the average radius. With said ferromagnetic plates, it is not possible to produce a sufficiently large additional magnetic field for ensuring isochronism. On the other hand, the volume comprised between two hills does not allow azimuthal widening of said ferromagnetic plates with the purpose of generating an additional magnetic field.

The document <<Magnetic field design and calculation for the IBA C70 cyclotron>> S. Zaremba et al., Cyclotrons and their applications 2007, Eighteenth International Conference, pages 75-77, describes the development of an isochronous cyclotron called C70 or Cyclone 70, capable of accelerating 4 types of particles: protons (q/m=1) and alpha particles (q/m=½) to an energy of 70 MeV, as well as deuterons (q/m=½) and $HH^+$ (q/m=½) to an energy of 35 MeV. This document explains the different solutions which have been contemplated in order to obtain a cyclotron which may operate according to two different isochronous magnetic fields so as to simulate a type of particles with a desired q/m ratio. This cyclotron C70 comprises hills divided into three superposed portions and parallel to the middle plane:

- a first portion away from the middle plane forming the basis of the hill;
- a second central portion forming a pole around which are wound correction coils with a specific distribution and;
- a third portion, the closest to the middle plane, being a plate for shielding the correction coils.

This configuration of hills is nevertheless complicated and requires very accurate alignment of said three portions as well as very accurate distribution of the coils. As an intensive vacuum is required inside the cyclotron, in particular for accelerating negatively charged particles, the assembly should be able to support significant variations in pressure, without this producing misadjustment of the different parts. Also, during the application of vacuum to the cyclotron, degassing problems at the correction coils may occur, the latter being confined between the base of the hill and the shielding plate. Finally, it is necessary to optimize the thickness of the shielding plate so that the magnetic flux fraction useful for accelerating the particles in the gap is sufficient while retaining some mechanical rigidity of said plate.

The object of the present invention is to provide a cyclotron capable of accelerating types of particles with different <<charge-over-mass>> q/m ratios, not having the drawbacks of the prior art.

Another object of the present invention is to provide a cyclotron with means for correcting the profile of the magnetic field according to the q/m ratio of the type of particles to be accelerated, said means allowing a simpler embodiment than the means of the prior art.

Another object of the present invention is to provide a cyclotron with a means for correcting the profile of the magnetic field according to the q/m ratio of the type of particles to be accelerated, said means may produce a sufficient additional magnetic field in the case of medium to high energy cyclotrons.

Another object of the present invention is to provide a cyclotron with a means for correcting the magnetic field profile not perturbing the internal vacuum of the cyclotron.

SUMMARY OF THE INVENTION

The present invention relates to a cyclotron capable of producing a first beam of accelerated charged particles defined by a first <<charge-over-mass>> ratio (q/m) or a second beam of accelerated charge particles defined by a second <<charge-over-mass>> ratio (q/m)' less than said first <<charge-over-mass>> ratio (q/m), said cyclotron comprising:

- an electromagnet comprising two poles, preferably an upper pole and a lower pole, positioned symmetrically relatively to a middle plane perpendicular to the central axis of the cyclotron and separated by a gap provided for circulation of charged particles, each of said poles comprising several sectors positioned so as to have an alternation of areas with a narrow gap called <<hills>> and areas with a wide gap called <<valleys>>;
- a main induction coil for generating an essentially constant main induction field in the gap between said poles and
- a means for modifying the magnetic field profile according to the <<charge-over-mass>> ratio of the particles to be accelerated, comprising a ferromagnetic part present in one of said valleys and extending radially from a region close to the center to the periphery of the cyclotron, said ferromagnetic part forming a magnetic circuit with the bottom of said valley, so as to generate a sufficiently large additional magnetic field for accelerating particles of said first beam having said first charge-over-mass ratio (q/m); characterized by:
- a secondary induction coil positioned around said ferromagnetic part so as to be able to induce a magnetic field opposing the magnetic field induced in said ferromagnetic part by said main induction coil and reduce the contribution of the additional magnetic field provided by said ferromagnetic part for the acceleration of particles of said second beam having said second charge-over-mass ratio (q/m)'.

Preferably, the secondary induction coil is positioned around said ferromagnetic part in a way parallel to said main induction coil.

Preferably, said ferromagnetic part comprises:

- a first portion, extending from the center to the periphery of said cyclotron, forming a gap, and;
- a second portion comprising a pillar made in a ferromagnetic material supporting said first portion.

Preferably, said secondary induction coil surrounds said pillar.

Preferably, the cyclotron comprises means for modifying the magnetic field profile located in two opposite valleys.

Preferably, the cyclotron is characterized by:

an aperture located in the bottom of a valley, allowing the passage of the totality of said ferromagnetic part or said pillar;

a mechanical device allowing said ferromagnetic part to be moved away from the middle plane when it is desired to accelerate particles having the second <<charge-over-mass>> ratio (q/m)' or said ferromagnetic part to be moved closer to the middle plane when it is desired to accelerate particles having the first <<charge-over-mass>> ratio (q/m).

According to another aspect, the present invention relates to a method for producing a beam of accelerated charged particles and characterized by the fact that:

a cyclotron according to any of the preceding claims is used for producing said beam of accelerated charged particles; and the current intensity in said secondary induction coil is regulated or adjusted according to the <<charge-over-mass>> ratio of the particles to be accelerated.

Preferably, the method is characterized in that:

a first beam of accelerated charged particles defined by a first <<charge-over-mass>> ratio (q/m) is produced by means of said cyclotron, without applying any current in said secondary induction coil; and/or a second beam of accelerated charged particles defined by a second <<charge-over-mass>> ratio (q/m)' is produced by means of said cyclotron by applying a current in said secondary induction coil so as to induce a magnetic field opposing said main induction field, the first charge-over-mass ratio (q/m) being greater than the second charge-over-mass ratio (q/m)'.

Preferably, the method is characterized in that:

a current is applied in said secondary induction coil so as to induce a magnetic field opposing said main induction field if one switches from the acceleration of a first beam of the particles having the first <<charge-over-mass>> ratio (q/m) to the acceleration of a second beam of particles having the second <<charge-over-mass>> ratio (q/m)'.

Preferably, the method is characterized in that:

closing of the passage of the current in said secondary induction coil is provided if one switches from the acceleration of a second beam of particles having the second <<charge-over-mass>> ratio (q/m)' to the acceleration of a first beam of particles having the <<charge-over-mass>> ratio (q/m).

Preferably, the method is characterized in that a beam of particles is accelerated onto a target comprising a radio-isotope precursor.

According to a last aspect, the present invention also relates to a use of a cyclotron as described above or of the method as described above for producing radio-isotopes.

DETAILED DESCRIPTION OF THE INVENTION

Figure 1:
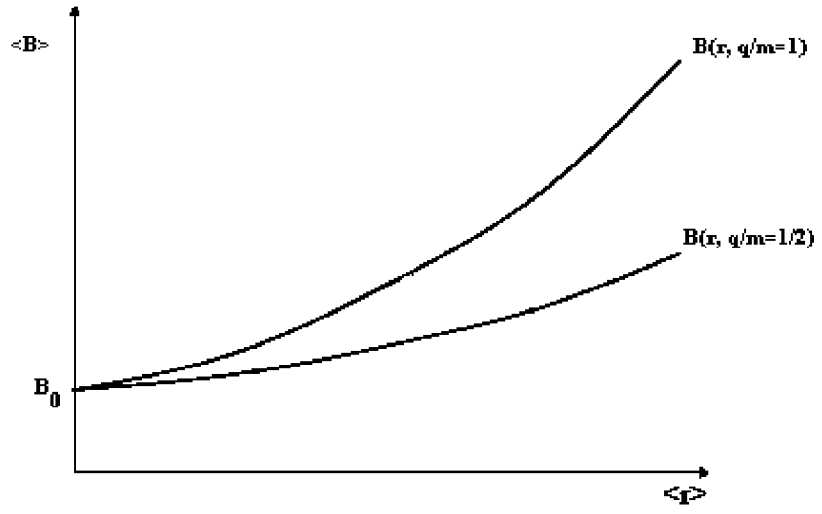
FIG. 1 represents the average magnetic field profile <B> to be applied in an isochronous cyclotron versus the average radius <R> of the particle, for accelerating protons and deuterons.

The device of the present invention is a cyclotron capable of producing a beam of accelerated charge particles defined by a <<charge-over-mass>> ratio (q/m) or a beam of accelerated particles defined by a <<charge-over-mass>> ratio (q/m)' less than said <<charge-over-mass>> ratio (q/m). Said cyclotron is capable of accelerating particles with a <<charge-over-mass>> ratio (q/m), for example equal to 1 like protons or particles with a ratio (q/m)' equal to a ½, such as alpha particles, deuterons, $HH^{+}$, $^{6}Li^{3+}$, $^{10}B^{5+}$ or $^{12}C^{6+}$ or other particles of the same ratio (q/m)'=½. Said cyclotron according to the present invention is illustrated in FIGS. 2 to 6. Said cyclotron comprises a magnetic circuit comprising:

an electromagnet comprising two poles, an upper pole and a lower pole, said poles being positioned symmetrically relatively to a middle plane 13 perpendicular to the central axis 12 of the cyclotron, and separated by a gap 14 provided for circulation of charged particles, each of said poles comprising several sectors positioned so as to have an alternation of areas with a narrow gap called <<hills>> 5 and areas with a wide gap called <<valleys>> 4;

flux returns 7 for closing said magnetic circuit;

a main induction coil 6 for generating an essentially constant main induction field in the gap 14 between said poles and;

a means for modifying the magnetic field profile according to the q/m ratio of the type of particles to be accelerated.

Said cyclotron is characterized in that said means for modifying the magnetic field profile comprises:

a ferromagnetic part 2, generally made in soft iron, present in one of said valleys 4 and extending from a region close to the center to the periphery of the cyclotron, said ferromagnetic part 2 forming a magnetic circuit with the bottom of said valley, so as to generate a sufficiently large additional magnetic field for accelerating particles with a <<charge-over-mass>> ratio (q/m);

a means allowing decrease of the additional magnetic field contribution provided by said ferromagnetic part 2, so as to accelerate particles with a <<charge-over-mass>> ratio (q/m)'.

In said means for modifying the magnetic field profile, said ferromagnetic part 2 may assume different shapes as long as a portion or the totality of the latter extends from the center to the periphery of cyclotron. For example, said ferromagnetic part 2 may comprise:

a first portion extending from the center to the periphery of the cyclotron, forming a gap and;

a second portion comprising a ferromagnetic pillar 3, connected to the flux returns 7 and supporting said first portion.

Said cyclotron may for example comprise two means for modifying the magnetic field profile located in opposite valleys 4. Two other opposite valleys comprise acceleration electrodes commonly called <<dice>> (not shown).

For example, said cyclotron may comprise four hills 5, each of these hills 5 being separated from each other by valleys 4. In this non-limiting example of the present invention, the sectors of the cyclotron are arranged according to symmetry of order 4, with two opposite valleys 4 comprising said means for modifying the magnetic field and two other valleys comprising the dice.

Figure 2:
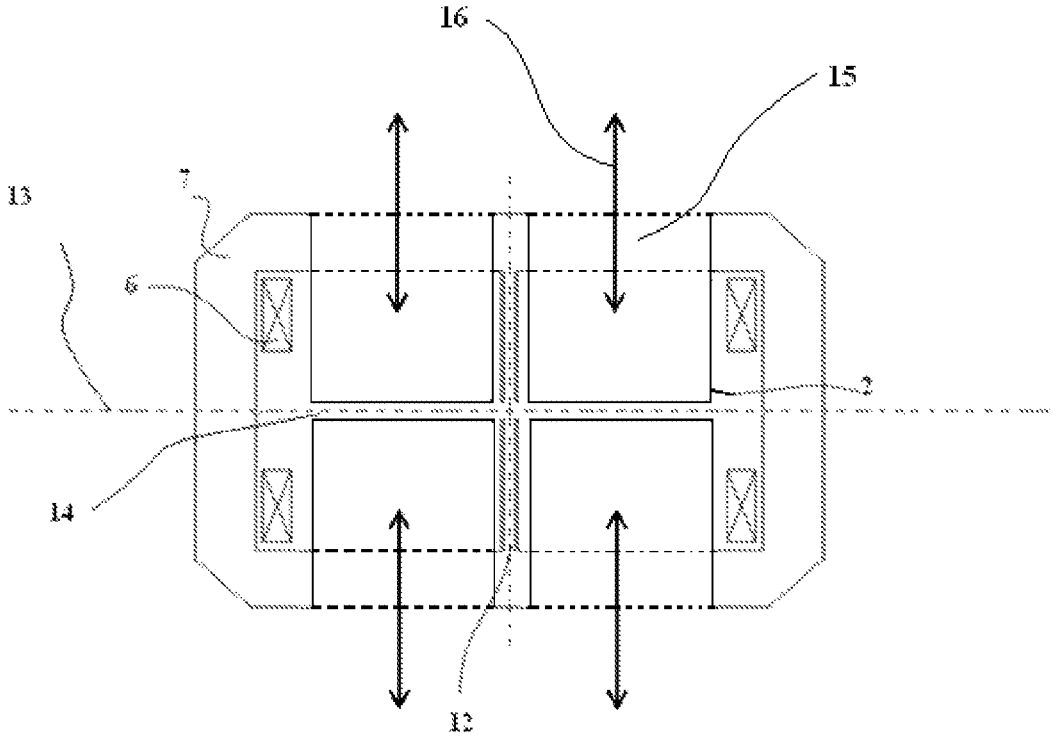
FIG. 2 illustrates a schematic sectional view along a plane perpendicular to the middle plane of a cyclotron according to a first embodiment of the present invention.

According to a first embodiment of the invention illustrated in FIG. 2, said means allows a decrease in the contribution of the additional magnetic field, comprises:

an aperture 15 located in the bottom of a valley, allowing the passage of the totality of said ferromagnetic part 2 or said pillar 3 and;

a mechanical device 16 allowing said ferromagnetic part 2 to be moved away from the middle plane when it is desired to accelerate particles with a <<charge-over-mass>> ratio (q/m)' or said ferromagnetic part 2 to be moved closer to the middle plane when it is desired to accelerate particles with a <<charge-over-mass>> ratio (q/m).

Figure 3:
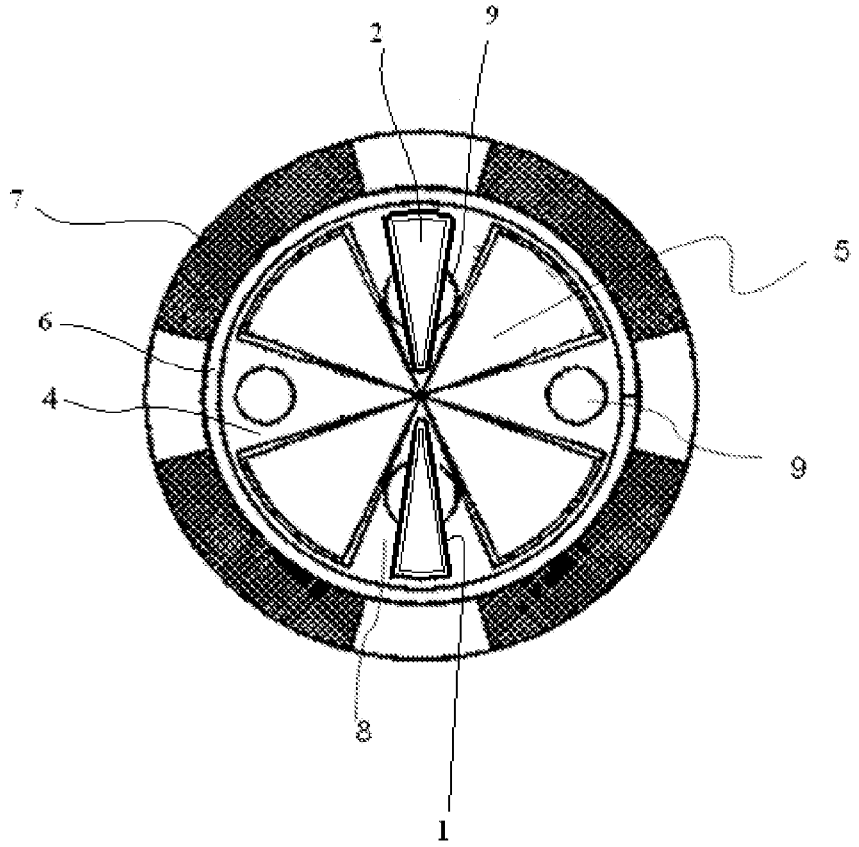
FIG. 3 illustrates a schematic sectional view along the middle plane of the cyclotron according to a second embodiment of the present invention.
Figure 4:
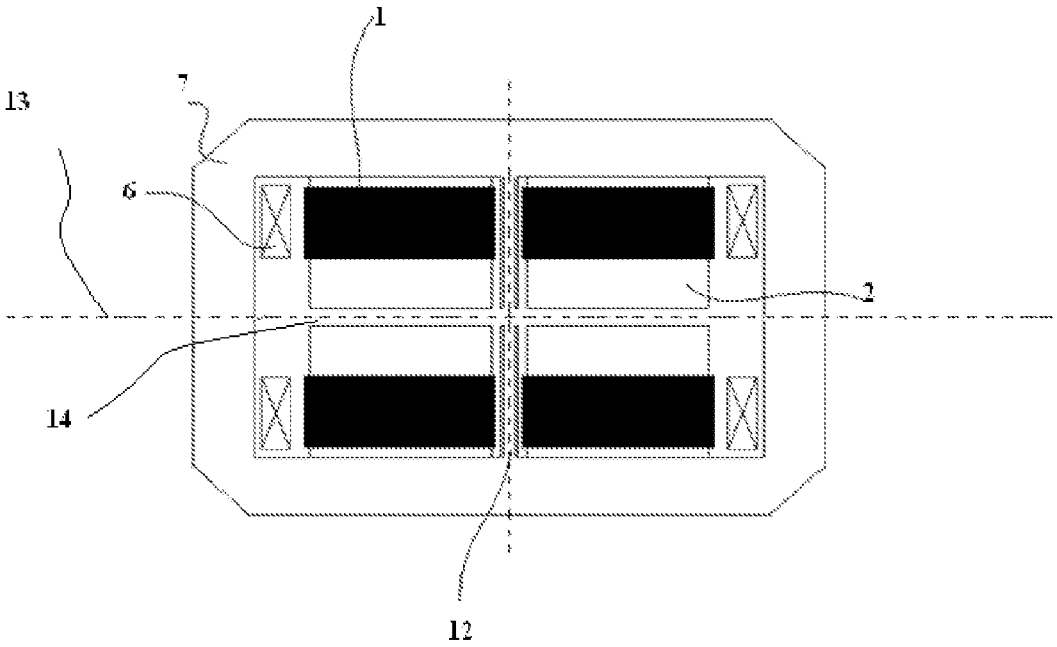
FIG. 4 illustrates a schematic sectional view along a plane perpendicular to the middle plane of a cyclotron according to a second embodiment of the present invention.

In a second embodiment illustrated in FIGS. 3 and 4, said means allowing decrease in the contribution of the additional magnetic field comprises a secondary induction coil positioned around said ferromagnetic part 2 in a way parallel to said main induction coil 6. Said secondary induction coil 1 is connected to an electric power supply device 11 giving the possibility of having a counter-current inducing a magnetic field opposing the magnetic field induced in said ferromagnetic part by said main induction coil 6.

Figure 5:
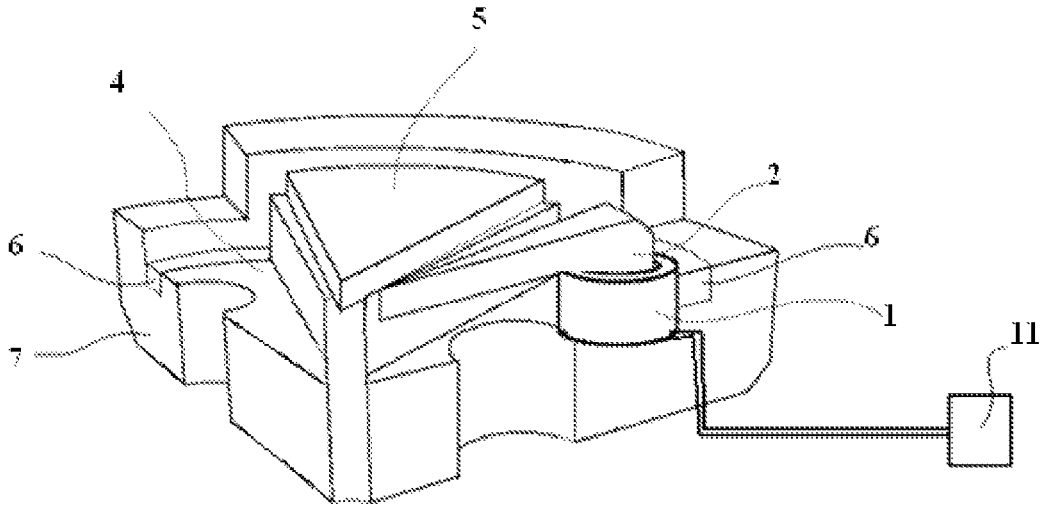
FIG. 5 illustrates a three-dimensional view of a portion of a cyclotron according to a third embodiment of the present invention.
Figure 6:
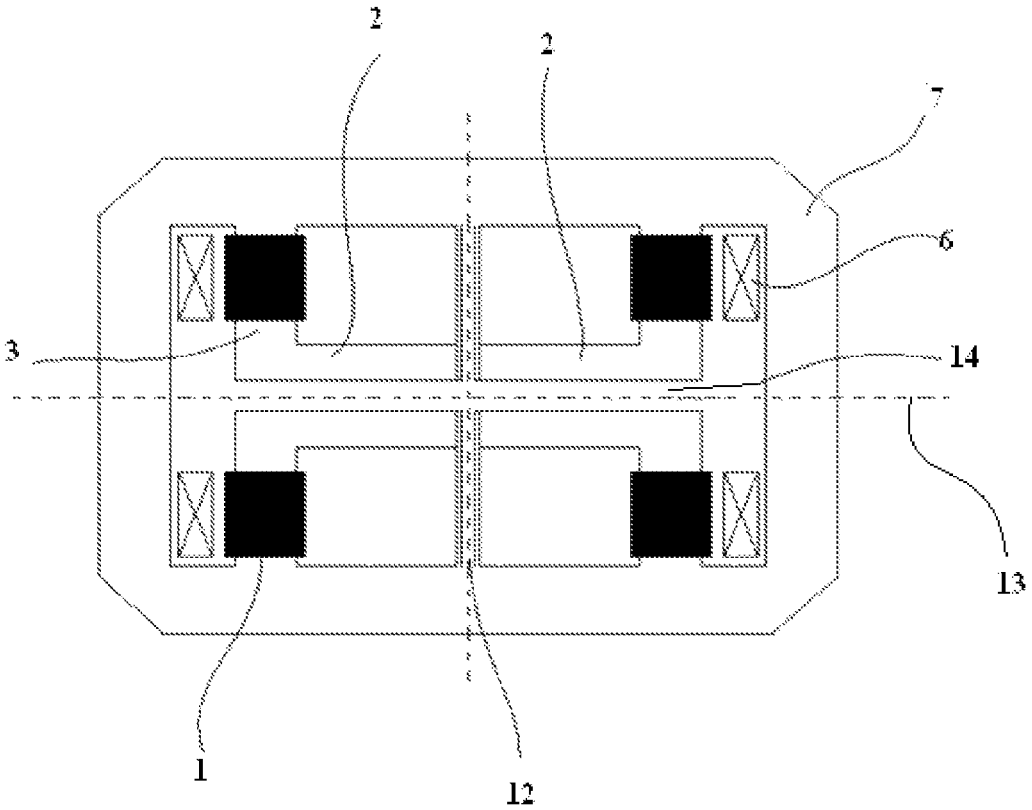
FIG. 6 illustrates a schematic sectional view along a plane perpendicular to the middle plane of a cyclotron according to a third embodiment of the present invention.

In a third embodiment of the invention illustrated in FIGS. 5 and 6, said ferromagnetic part 2 comprises:

a first portion extending from the center to the periphery of the cyclotron, forming a gap and;

a second portion comprising a ferromagnetic pillar 3, connected to the flux returns 7 and supporting said first portion, said secondary induction coil 1 surrounding said pillar 3 and is positioned in a way parallel with said main induction coil 6.

In order to avoid overheating due to the passing of the current in the secondary induction coil 1, the latter may be surrounded by a cooling element (not shown) allowing its cooling. Said secondary induction coil 1 may be surrounded by a metal frame with which it is possible to avoid degassing problems at the turns when a vacuum is generated in the cyclotron.

Preferably, the cyclotron according to the present invention comprises:

a first portion, extending from the center to the periphery of said cyclotron, forming a gap, and;

a second portion comprising a pillar made in a ferromagnetic material supporting said first portion.

Advantageously, the cyclotron according to the present invention comprises means for correcting the magnetic field profile located in two opposite valleys.

Preferably, said means allowing decrease in the contribution of additional magnetic field provided by said ferromagnetic part, comprises:

an aperture located in the bottom of a valley, letting through the totality of said ferromagnetic part or said pillar;

a mechanical device allowing said ferromagnetic part to be moved away from the middle plane when it is desired to accelerate particles having the second <<charge-over-mass>> ratio (q/m)' or said ferromagnetic part to be moved closer to the middle plane when it is desired to accelerate particles having the first <<charge-over-mass>> ratio (q/m).

Advantageously, said means allowing a decrease in the contribution of the additional magnetic field provided by said ferromagnetic part comprises:

a secondary induction coil positioned around said ferromagnetic part in a parallel way to said main induction coil and connected to an electric power supply means allowing a current inducing a magnetic field opposing the magnetic field induced in said ferromagnetic part to pass through said main coil.

Advantageously, said secondary induction coil surrounds said pillar.

The present invention also relates to a method for correcting the magnetic field profile in a cyclotron capable of producing a first beam of accelerated charge particles defined by a first <<charge-over-mass>> ratio (q/m) or a second beam of accelerated charge particles defined by a second <<charge-over-mass>> ratio (q/m)' less than said first <<charge-over-mass>> ratio (q/m), said cyclotron comprising a magnetic circuit comprising:

an electromagnet comprising two poles, an upper pole and a lower pole, said poles being positioned symmetrically relatively to a middle plane perpendicular to the central axis of the cyclotron, and separated by a gap provided for circulation of charged particles, each of said poles comprising several sectors positioned so as to have an alternation of areas with a narrow cap called <<hills>> and of areas with a wide gap called <<valleys>>, so as to ensure refocusing of said beam in the middle plane;

flux returns for closing said magnetic circuits;

a main induction coil for generating an essentially constant main induction field in the gap between said poles;

a means for correcting the magnetic field profile according to the ratio q/m of the type of particle to be accelerated; characterized in that a means for correcting the profile of the magnetic field is provided comprising:

a ferromagnetic part comprised in one of said valleys and extending radially from a region close to the center to the periphery of the cyclotron, said ferromagnetic part forming a magnetic circuit with the bottom of said valley, so as to generate a sufficiently large additional magnetic field for accelerating particles of the first beam having the first <<charge-over-mass>> ratio (q/m);

a means allowing a decrease in the contribution of the additional magnetic field provided by said ferromagnetic part, so as to accelerate the particles of the second beam having the second <<charge-over-mass>> ratio (q/m)'.

Preferably, said ferromagnetic part comprises:

a first portion, extending from a center to the periphery of said cyclotron, forming a gap, and;

a second portion comprising a pillar made in a ferromagnetic material and supporting said first portion.

Advantageously, said means allowing a decrease in the contribution of the additional magnetic field provided by said ferromagnetic part comprises:

an aperture located in the bottom of a valley, letting through the totality of said ferromagnetic part or said pillar;

a mechanical device allowing said ferromagnetic part to be moved away from the middle plane when it is desired to accelerate particles having the second <<charge-over-mass>> ratio (q/m)' or said ferromagnetic part to be moved closer to the middle plane when it is desired to accelerate particles having the first <<charge-over-mass>> ratio (q/m).

Still preferably, for said means allowing a decrease in the contribution of the additional magnetic field provided by said ferromagnetic part, provision is made for:

a secondary induction coil positioned around said ferromagnetic part in a way parallel to said main induction coil and connected to an electric power supply means giving the possibility of having a current inducing a magnetic field opposing the magnetic field induced in said ferromagnetic part pass through said main coil.

Advantageously, the current intensity is regulated or adjusted in said secondary induction coil according to the <<charge-over-mass>> ratio of the particle to be accelerated.

More preferably, the method according to the invention comprises the step for producing a first beam of accelerated particles defined by a first <<charge-over-mass>> ratio (q/m) by means of said cyclotron, without applying any current in said secondary induction coil, or for producing a second beam of particles defined by a second <<charge-over-mass>> ratio (q/m)' by means of said cyclotron by applying a current in said secondary induction coil so as to induce a magnetic field opposing said main induction field, the first <<charge-over-mass>> ratio (q/m) being greater than the second <<charge-over-mass>> ratio (q/m)'.

Still preferably, the method according to the invention comprises the step for applying a current in said secondary induction coil so as to induce a magnetic field opposing said main induction field if one switches from the acceleration of a first beam of particles having the first <<charge-over-mass>> ratio (q/m) to the acceleration of a second beam of particles having the second <<charge-over-mass>> ratio (q/m)', or closing the passing of the current in said secondary induction coil if one switches from the acceleration of a second beam of particles having the second <<charge-over-mass>> ratio (q/m)' to the acceleration of a first beam of particles having the <<charge-over-mass>> ratio (q/m).

Preferably, the beam of particles is accelerated on a target comprising a radio isotope precursor.

The present invention also relates to the use of said method or said cyclotron for producing a radio isotope.

Example of Use of the Present Invention

In an isochronous cyclotron according to the present invention, it is possible to select a type of particle with a <<charge-over-mass>> ratio q/m, to be accelerated such as for example protons (q/m=1) or deuterons q/m=½), other particles may also be accelerated. In the non-limiting case of an isochronous cyclotron capable of accelerating protons to an energy of 70 MeV, the position of said ferromagnetic part 2 in two opposite valleys, influences the flux lines of the magnetic field induced by said main induction coil 6 and provides an additional magnetic field with which it is possible to obtain the isochronous magnetic field required for accelerating protons. If it is desired with this same cyclotron to accelerate deuterons or other particles with a <<charge-over-mass>> ratio equal to a ½, to an energy of 35 MeV, the profile of the magnetic field has to be modified so as to obtain an isochronous magnetic field profile as shown in FIG. 1. Therefore the additional magnetic field provided by said ferromagnetic part 2 therefore has to be reduced. This may be achieved by applying in said secondary induction coil 1 a counter-current generating a magnetic field opposing the main magnetic field induced by said main induction coil 6, so as to obtain the isochronous magnetic field required for accelerating deuterons or particles with a <<charge-over-mass>> ratio equal to a ½. These <<charge-over-mass>> ratios of 1 and a ½ are not a limitation of the present invention and other <<charge-over-mass>> ratios may be considered.

With the present invention, it is possible to avoid resorting to a complex winding and machine system at the sectors. The second and third embodiments of the present invention give the possibility of avoiding resorting to a mobile system for passing from an isochronous magnetic field required for accelerating one type of particles with a <<charge-over-mass>> ratio q/m, to another. Another substantial advantage of the second and third embodiments of the present invention is that in the case of an approximate machining of the poles, it is always possible to correct the magnetic field by varying the current in the secondary induction coil 1 so as to obtain the desired isochronous magnetic field with good accuracy.

The present invention may be used for accelerating particles with a ratio q/m onto a target for producing radio isotopes. For example, in a first use, said cyclotron may be used for accelerating particles with a <<charge-over-mass>> ratio q/m equal to 1, such as for example protons onto a target comprising a radio isotope precursor. In a second use, the magnetic field in said cyclotron may be modified so as to accelerate particles with a <<charge-over-mass>> ratio (q/m)' equal to a ½, such as for example deuterons, onto a target comprising a radio isotope precursor.

List of the Elements

1 secondary induction coil
2 metal part
3 pillar
4 valley
5 hill
6 main induction coil
7 flux return
9 pumping hole
11 electric power supply means
12 central conduit
13 middle plane
14 gap
15 aperture
16 mechanical means

The invention claimed is:

1. A cyclotron capable of producing a first beam of accelerated charged particles defined by a first charge over mass ratio (q/m) or a second beam of accelerated charged particles defined by a second charge over mass ratio (q/m)' less than said first charge over mass ratio (q/m), said cyclotron comprising:

an electromagnet comprising two poles positioned symmetrically relatively to a middle plane perpendicular to the central axis of the cyclotron and separated by a gap provided for circulation of the charged particles, each of said poles comprising several sectors positioned so as to have an alternation of areas with a narrow gap called hills and areas with a wide gap called valleys;

a main induction coil for generating an essentially constant main induction field in the gap between said poles;

a means for modifying the magnetic field profile according to the <<charge over mass>> ratio of the particles to be accelerated, comprising a ferromagnetic part present in one of said valleys and extending radially from a region close to the center to the periphery of the cyclotron, said ferromagnetic part forming a magnetic circuit with the bottom of said valley, so as to generate a sufficiently large additional magnetic field for accelerating particles of said first beam having said first charge over mass ratio (q/m); and a secondary induction coil positioned around said ferromagnetic part so as to be able to induce a magnetic field opposing the magnetic field induced in said ferromagnetic part by said main induction coil and decrease the contribution of the additional magnetic field provided by said ferromagnetic part for accelerating particles of said second beam having said second charge over mass ratio (q/m)'.

2. The cyclotron according to claim 1, wherein said secondary induction coil is positioned around said ferromagnetic part in a parallel way to said main induction coil.

3. The cyclotron according to claim 1, wherein said ferromagnetic part comprises:

a first portion, extending from the center to the periphery of said cyclotron, forming a gap; and a second portion comprising a pillar made in a ferromagnetic material supporting said first portion.

4. The cyclotron according to claim 3, wherein said secondary induction coil surrounds said pillar.

5. The cyclotron according to claim 1, comprising means for modifying the magnetic field profile located in two opposite valleys.

6. The cyclotron according to claim 1, further comprising:

an aperture located in the bottom of a valley, letting through the totality of said ferromagnetic part or said pillar; and a mechanical device allowing said ferromagnetic part to be moved away from the middle plane when it is desired to accelerate particles having the second charge over mass ratio (q/m)' or said ferromagnetic part to be moved closer to the middle plane when it is desired to accelerate particles having the first charge over mass ratio (q/m).

7. A method for producing a beam of accelerated charged particles, wherein a cyclotron according to claim 1 is used for producing said beam of accelerated charged particles; and the current intensity is regulated or adjusted in said secondary induction coil according to the charge over mass ratio of the particles to be accelerated.

8. The method according to claim 7, wherein a first beam of accelerated charged particles defined by a first charge over mass ratio (q/m) is produced by means of said cyclotron, without applying any current in said secondary induction coil; and/or a second beam of accelerated charged particles defined by a second charge over mass ratio (q/m)' is produced by means of said cyclotron by applying a current in said secondary induction, so as to induce a magnetic field opposing said main induction field, the first charge over mass ratio (q/m) being greater than the second charge over mass ratio (q/m)'.

9. The method according to claim 8, wherein a current is applied in said secondary induction coil so as to induce a magnetic field opposing said main induction field if one passes from the acceleration of a first beam of particles having the first charge over mass ratio (q/m) to the acceleration of a second beam of particles having the second charge over mass ratio (q/m)'.

10. The method according to claim 8, wherein provision is made for closing the passing of the current into said secondary induction coil if one switches from the acceleration of a second beam of particles having the second charge over mass ratio (q/m)' to the acceleration of a first beam of particles having the charge over mass ratio (q/m).

11. The method according to claim 7, wherein a beam of particles is accelerated onto a target comprising a radio isotope precursor.

12. The use of the cyclotron according to claim 1 for producing radio isotopes.

* * * * *